US006190127B1

(12) United States Patent
Schmidt

(10) Patent No.: US 6,190,127 B1
(45) Date of Patent: Feb. 20, 2001

(54) TUNING THERMAL MISMATCH BETWEEN TURBINE ROTOR PARTS WITH A THERMAL MEDIUM

(75) Inventor: Mark Christopher Schmidt, Niskayuna, NY (US)

(73) Assignee: General Electric Co., Schenectady, NY (US)

( * ) Notice: Under 35 U.S.C. 154(b), the term of this patent shall be extended for 0 days.

(21) Appl. No.: 09/218,230

(22) Filed: Dec. 22, 1998

(51) Int. Cl.[7] ..... F01D 5/08

(52) U.S. Cl. ..... 416/95; 416/39; 416/198 A; 416/201 R; 416/96 R; 416/96 A; 415/175; 415/176; 415/178; 415/148

(58) Field of Search ..... 415/47, 48, 115, 415/116, 117, 175–178, 134, 136, 138; 416/39, 95, 96 R, 96 A, 97 R, 198 A, 200 A, 201 R

(56) References Cited

U.S. PATENT DOCUMENTS 4,419,044 * 12/1983 Barry et al. ..... 415/175
4,844,694 * 7/1989 Naudet ..... 416/198 A
5,281,085 * 1/1994 Lenahan et al. ..... 415/116
5,605,437 * 2/1997 Meylan ..... 415/175

FOREIGN PATENT DOCUMENTS

394001 * 6/1933 (GB) ..... 416/201 R
635783 * 4/1950 (GB) ..... 416/97 R
2-9901 * 1/1990 (JP) ..... 416/96 R

* cited by examiner

*Primary Examiner*—Christopher Verdier
(74) *Attorney, Agent, or Firm*—Nixon & Vanderhye

(57) ABSTRACT

In a turbine rotor, an aft shaft wheel and the final-stage wheel of the rotor are coupled together, including by a rabbeted joint. During shutdown and startup of the turbine, a thermal mismatch between the aft shaft wheel and final-stage wheel is avoided by respectively heating and cooling the aft shaft wheel to maintain the thermal mismatch within acceptable limits, thereby avoiding opening of the rabbeted joint and the potential for unbalancing the rotor and rotor vibration. The thermal medium may be supplied by piping in the aft bearing cavity into the cavity between the forward closure plate and the aft shaft wheel.

4 Claims, 1 Drawing Sheet

TUNING THERMAL MISMATCH BETWEEN TURBINE ROTOR PARTS WITH A THERMAL MEDIUM

This invention was made with Government support under Contract No. DE-FC21-95MC31176 awarded by the Department of Energy. The Government has certain rights in this invention.

TECHNICAL FIELD

The present invention relates generally to turbines and particularly to land-based gas turbines for power generation. More particularly, the present invention relates to tuning the thermal mismatch between rotor parts, for example, a turbine wheel and a spacer or aft shaft by controlling flow of a thermal medium on the exterior surface of one of the turbine parts to substantially eliminate the thermal mismatch or maintain it within a predetermined thermal mismatch.

BACKGROUND OF THE INVENTION

In a typical gas turbine, the turbine rotor is formed by stacking rotor wheels and spacers, the stacked plurality of wheels and spacers being bolted one to the other. Rabbeted joints are typically provided between the spacers and wheels. In more advanced gas turbines, cooling circuits are provided through the rotor for cooling the buckets. For example, cooling steam may be provided through an aft shaft forming part of the rotor assembly for flow along the rim of the rotor to the buckets of one or more of the turbine stages to cool the buckets. Spent cooling steam also flows from the buckets in a return path along the rim of the rotor and through the aft shaft.

BRIEF SUMMARY OF THE INVENTION

With the stack-up of rotor wheels and spacers, and with varying temperatures being applied to various rotor elements at different times during operation of the turbine, i.e., startup, steady-state operation and shutdown, it has been discovered, in accordance with the present invention, that a thermal mismatch between turbine rotor elements may be of sufficient magnitude during particular phases of turbine operation that relative movement of the turbine elements may occur, opening up the rabbeted joints, leading to the below-mentioned deleterious results. This mismatch occurs particularly in the present advanced gas turbine design because steam cooling circuits are provided in the aft shaft which mates with the wheel of the last turbine stage, e.g., the fourth stage. It will be appreciated that during steady-state turbine operation, the thermal mismatch between elements of the turbine rotor and particularly between the aft shaft and the last-stage wheel is within a predetermined acceptable range which substantially precludes relative movement between the wheels and spacers or the aft shaft and last-stage wheel, preventing the rabbeted joints from shifting or opening up. Thus, at steady-state operation, there is no relative movement of the turbine rotor parts which otherwise could cause the rotor to lose balance, possibly leading to high vibrations and a need for rebalancing or rotor replacement at substantial cost.

During turbine shutdown, however, hot gases of combustion no longer flow through the hot gas path and, in a relatively short period of time, approximately one hour, the turbine slows from 3000 rpm to 7 rpm. It will be appreciated that with only marginal flow through the turbine at this low rpm, with the steam cooling circuits shut down, and the relatively large mass of the turbine wheel, the temperature of the turbine wheel decreases at a substantially slower rate than the temperature decrease of the aft shaft, causing a thermal mismatch between those elements. A thermal mismatch of as much as 280° F. between these elements has been demonstrated during turbine shutdown. A large thermal mismatch such as this can unload the rabbeted joints and cause relative movement between the elements. Over time, of course, the thermal mismatch decreases until there is substantial thermal equilibrium between these elements.

Likewise, at startup of the turbine, thermal mismatches occur between various rotor elements. For example, at startup, the hot gas flowing through the hot gas path of the turbine heats up the last-stage turbine wheel very slowly because of its large mass. Conversely, the aft shaft which conveys the cooling medium, initially air and subsequently steam, heats up rather rapidly, causing a thermal mismatch between the aft shaft and last-stage wheel. This again may cause the rabbeted joint between these elements to open, resulting in the potential for an unbalanced rotor.

To solve the aforementioned problem of thermal mismatch, the temperature of at least one of the elements of the thermally mismatched pair of elements is preferentially heated or cooled, depending upon whether the turbine is being shut down or started, respectively. For example, during shutdown, a heated fluid medium, for example, hot air, is provided in a cavity between the aft shaft wheel surface and the forward closure plate. This heated air thus lies in heat transfer relation with the surface of the aft shaft wheel to prevent the aft shaft wheel from rapidly cooling. This flow of heated air reduces the thermal mismatch between the aft shaft wheel and the last-stage turbine wheel to a value within a predetermined acceptable thermal mismatch, for example, on the order of 70 or 80° F. difference. Similarly, during startup, a cooling medium, for example, air, is supplied in that same cavity to maintain the rate of increase in temperature of the aft shaft wheel in substantial correspondence with the increase in temperature of the last-stage wheel such that the thermal mismatch between those wheels at startup is maintained within predetermined acceptable limits. The heating or cooling medium may be provided through suitable piping into the forward closure plate cavity.

In a preferred embodiment according to the present invention, there is provided in a gas turbine having a pair of parts responsive to different applied temperatures creating a transient thermal mismatch, a method of maintaining the thermal mismatch between the parts within a predetermined thermal mismatch, comprising the step of flowing a fluid medium along a surface of one of the parts to either heat or cool one part to a temperature enabling the magnitude of the thermal mismatch of the parts to lie within the predetermined thermal mismatch.

In a further preferred embodiment according to the present invention, there is provided in a turbine having a turbine wheel and an aft wheel secured to and in axial registration with one another and with a rabbeted joint therebetween, the wheels being responsive to different applied temperatures creating a transient thermal mismatch therebetween, a method of preventing relative movement between the wheels consequent of a thermal mismatch between the wheels beyond a predetermined thermal mismatch, comprising the step of flowing a fluid medium along a surface of one of the wheels to either heat or cool the one wheel to a temperature reducing the thermal mismatch to a value within the predetermined thermal mismatch.

Accordingly, it is a primary object of the present invention, to provide apparatus and methods for maintaining the thermal mismatch between turbine rotor elements within a predetermined thermal mismatch by controlling the supply of heated or cooling medium to a surface of one of the elements.

DETAILED DESCRIPTION OF THE INVENTION

Figure 1:
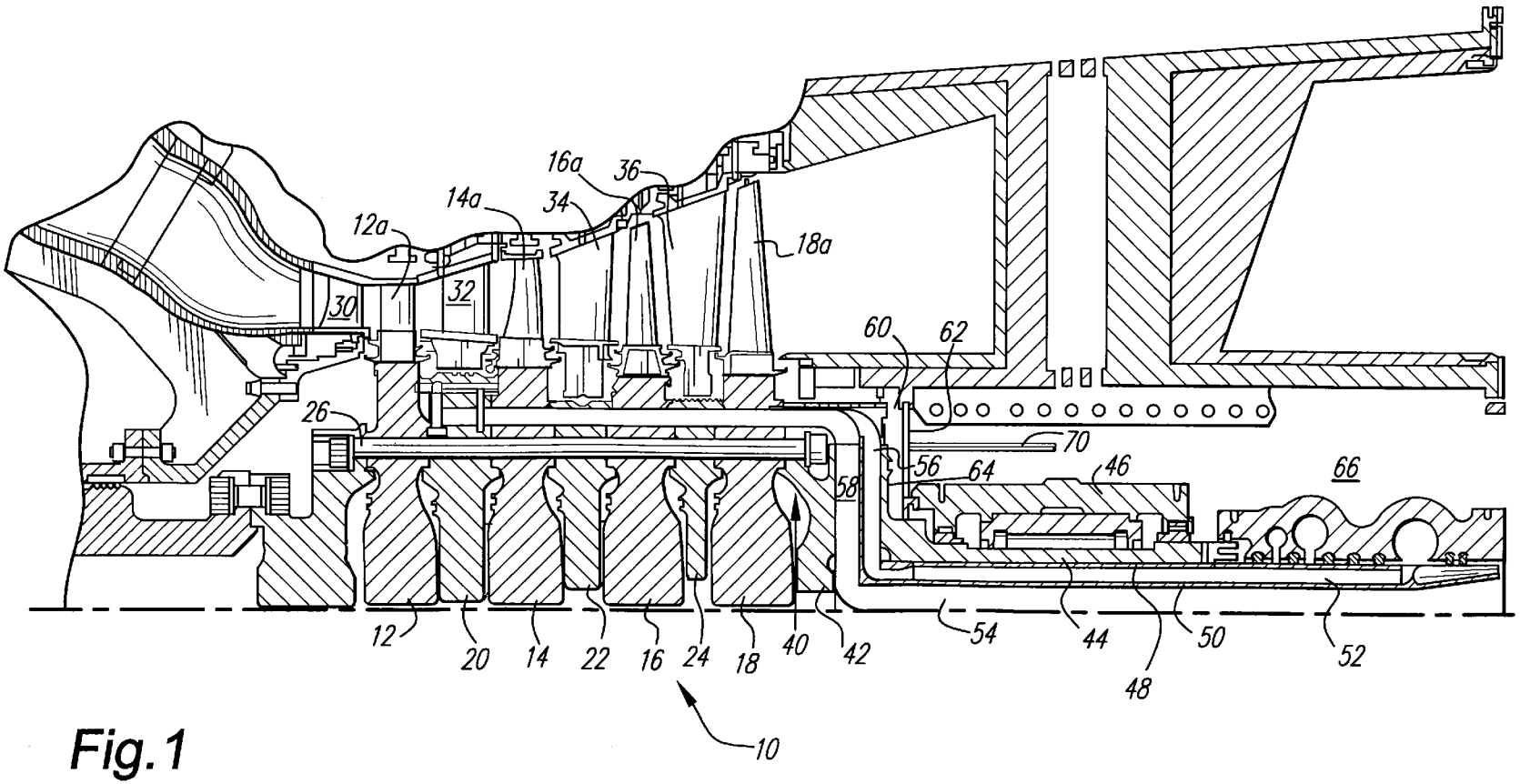
FIG. 1 is a fragmentary cross-sectional view of a portion of a turbine illustrating the manner in which the control of the thermal response of a pair of turbine elements is tuned.

Referring to FIG. 1, there is illustrated a portion of a turbine including a turbine rotor, generally designated 10, comprised of stacked elements, for example, the rotor wheels 12, 14, 16 and 18, which form portions of a four-stage exemplary turbine rotor, with spacers 20, 22 and 24 alternating between the wheels. It will be appreciated that the wheel and spacer elements are held together in the rotor by a plurality of elongated, circumferentially extending bolts, only one of which is illustrated, at 26. The wheels 12, 14, 16 and 18 mount a plurality of circumferentially spaced turbine buckets 12*a*, 14*a*, 16*a* and 18*a*, respectively. Nozzles 30, 32, 34 and 36 form stages with the buckets 12*a*, 14*a*, 16*a* and 18*a*, respectively. Note that the wheels and spacers lie in axial registration one with the other and that rabbeted joints are provided between the wheels and spacers. An exemplary rabbeted joint, designated 40, is illustrated between the last-stage wheel 18 and an aft shaft wheel 42 forming part of an aft shaft 44. The rabbeted joints are maintained locked to one another throughout all ranges of operation of the turbine. As illustrated, the aft shaft 44 is rotatable with the rotor 10 within an aft bearing 46.

In an advanced gas turbine design of the assignee hereof, the aft shaft 44 houses a bore tube assembly described and illustrated in detail in co-pending U.S. patent application Ser. No. 09/216,363. The bore tube assembly, in general terms, includes outer and inner tubes 48 and 50, respectively, defining an annular steam cooling passage 52 and a spent steam cooling return passage 54. The passages 52 and 54 communicate steam to and from the outer rim of the rotor through sets of radially extending bores or conduits 56 and 58, respectively, which in turn communicate with longitudinally extending tubes spaced about the rim of the rotor. Suffice to say, the steam supplied through the steam passage 52 and bores 56 supply cooling steam to buckets of the first and second stages, while the bores 58 and return passage 54 receive the spent cooling steam from the buckets for return.

As previously mentioned, thermal mismatches between various elements of the rotor occur during operation of the turbine, particularly during shutdown and turbine startup. During steady-state turbine operations, the temperature distribution among the various elements of the turbine lies within a predetermined range of thermal mismatch which would not deleteriously affect the operation of the turbine. However, during transient operations, i.e., shutdown and startup, thermal mismatches are significantly greater and must be accommodated. For example, the rabbeted joint 40 between the aft shaft wheel 42 and the wheel 18 of the final, e.g., fourth stage has a significant thermal mismatch well beyond an acceptable thermal mismatch. Such a large thermal mismatch may cause an open or unloaded rabbet. Such condition could cause the elements to move relative to one another and thus cause the rotor to lose balance, leading to high vibrations and a requirement for costly rebalancing or rotor replacement.

More particularly, during shutdown, the hot gases flowing through the hot gas path of the various turbine stages and the flow of steam through the bore tube cooling circuit assembly are terminated. Because the wheel 18 has a very large mass and has been heated to a high temperature during steady-state operation of the turbine, wheel 18 will lose heat at a very slow rate in comparison with the heat loss in the aft shaft wheel 42, causing a large thermal mismatch at the rabbeted joint 40. As noted previously, the thermal mismatch can be as large as 280° F., which could cause the rabbet to open. Similarly, a large thermal mismatch occurs at startup. At startup, the wheel 18 is cool and it acquires heat relatively slowly from the hot gas path in comparison with the rate of increase of heat absorbed in the aft wheel 42 by the flow of the cooling medium, e.g., air initially and thereafter cooling steam, through the passages 52, 54 and bore tubes 56 and 58. Thus, a substantial thermal gradient or thermal mismatch occurs between these two elements during transient conditions, i.e., the wheel 18 having an elevated temperature in comparison with the aft wheel 42 during shutdown, while the aft wheel 42 has an elevated temperature in comparison with the wheel temperature 18 during startup.

To reduce the thermal mismatch during these transient phases of turbine operation, a thermal medium is supplied the cavity 60 between the forward closure plate 62 and the aft surface of the aft shaft wheel 42. The thermal medium may be supplied by a series of piping 70 extending in the bearing cavity 66 and through the forward closure plate 62. The cavity 60 lies in communication with the hot gas path aft of the last stage.

The thermal medium supplied the cavity 60 through piping 70 may be provided from any suitable source. It will be appreciated that during shutdown, it is desirable to heat the aft shaft and aft shaft wheel to maintain the thermal mismatch between the aft shaft wheel 42 and the fourth-stage wheel 18 within an acceptable predetermined thermal mismatch. For example, an acceptable thermal mismatch which does not deleteriously affect the rabbeted joint 40 may be about 80° F. or less. That is, a thermal mismatch of that magnitude does not cause relative movement between the aft shaft 44 and fourth-stage wheel 18 which might open the rabbeted joint. Consequently, by heating the surface of the aft shaft wheel 42 during shutdown, the thermal mismatch between the aft shaft wheel and fourth-stage wheel 18 is maintained within predetermined limits.

Conversely, during startup, a cooling medium may be provided through the piping 70 into the cavity 60. By cooling the aft shaft wheel, its temperature may be maintained within the range of acceptable thermal mismatch between the aft shaft wheel and fourth-stage wheel 18 as the wheel 18 more slowly heats up from the hot gases flowing in the hot gas path. Once steady-state operation is reached and the thermal mismatch can be maintained within acceptable limits due to substantial temperature equilibrium between the wheel 18 and the aft shaft 44, the cooling medium supplied to the aft shaft 44 can be terminated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a gas turbine having a pair of parts responsive to different applied temperatures creating a transient thermal mismatch, said turbine including a turbine rotor wheel for mounting buckets and an adjoining wheel having a rabbeted joint between registering faces thereof, a method of maintaining the thermal mismatch between said parts within a predetermined thermal mismatch, comprising the steps of:

flowing a fluid medium along a surface of one of said parts to either heat or cool said one part to a temperature enabling the magnitude of the thermal mismatch of said parts to lie within said predetermined thermal mismatch; and flowing the fluid medium along a face of the adjoining wheel axially remote from the turbine rotor wheel to reduce the thermal mismatch to within said predetermined thermal mismatch to preclude relative displacement of elements forming the rabbeted joint.

2. A method according to claim 1 including starting the turbine by flowing hot gases of combustion through the turbine, causing an increased thermal mismatch between said parts, and flowing a cooling medium along said one surface to maintain the thermal mismatch between said parts to within said predetermined thermal mismatch.

3. A method according to claim 1 including shutting down the turbine by terminating flow of hot gases of combustion through the turbine thereby causing an increased thermal mismatch between said parts, and flowing a heating medium along said one surface to maintain the thermal mismatch between said parts to within said predetermined thermal mismatch.

4. A method according to claim 1 including starting the turbine by flowing hot gases of combustion through the turbine thereby causing an increased thermal mismatch between said parts and flowing a cooling medium along said one surface to maintain the thermal mismatch between said parts to within said predetermined thermal mismatch, operating the turbine at steady-state, and shutting down the turbine by terminating flow of hot gases of combustion through the turbine thereby causing an increased thermal mismatch between said parts and flowing a heating medium along said one surface to maintain the thermal mismatch between said parts to within said predetermined thermal mismatch.

* * * * *